United States Patent [19]

Jursich et al.

[11] Patent Number: 5,075,969

[45] Date of Patent: Dec. 31, 1991

[54] SHOWER SHAVER

[75] Inventors: Donald N. Jursich, Chicago; Jefferson L. Gentry, Deerfield, both of Ill.

[73] Assignee: Associated Mills Inc., Chicago, Ill.

[21] Appl. No.: 607,302

[22] Filed: Oct. 31, 1990

Related U.S. Application Data

[63] Continuation-in-part of Ser. No. 501,029, Mar. 29, 1990, Pat. No. 4,995,155.

[51] Int. Cl.[5] ..... B26B 19/44; B26B 19/48; B25F 3/00

[52] U.S. Cl. ..... 30/41; 30/41.5; 30/123.3

[58] Field of Search ..... 30/41, 41.5, 123.3, 30/86

[56] References Cited

U.S. PATENT DOCUMENTS

| | | | |
|---|---|---|---|
| 4,205,441 | 6/1980 | Turner | 30/41.5 |
| 4,633,585 | 1/1987 | Whitaker et al. | 30/41 |
| 4,868,982 | 9/1989 | McComas | 30/41 |

*Primary Examiner*—Douglas D. Watts
*Assistant Examiner*—Paul M. Heyrana, Sr.
*Attorney, Agent, or Firm*—Laff, Whitesel, Conte & Saret

[57] ABSTRACT

A shower shaver is made from two plastic piece parts. A first part is a handle in the nature of a pipe terminating in a fan-shaped or flared, tray like top surface. The other piece part is a cover or top which fits over and cooperates with the tray top to form a cavity which delivers a flared sheet of water toward orifices which cause the water to strike to a broad surfaces of said blade and then exits under the cutting edge of the blade with enough force to wash debris away from the blade. A notch beneath the flaired surface delivers a stream of water to the skin in advance of the cutting edge. A tubing or hose attached to the shower shaver razor leads to a nipple which may be interposed between a shower head and a plumbing pipe. A valve on the nipple provides a continuously variable control over the flow of water to the shaver and/or the shower head. A bracket or hanger is attached to the nipple to receive and support the razor when it is not in use.

9 Claims, 3 Drawing Sheets

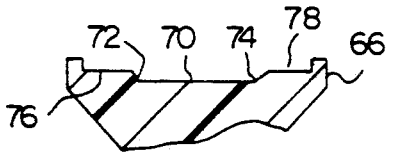
FIG. 5
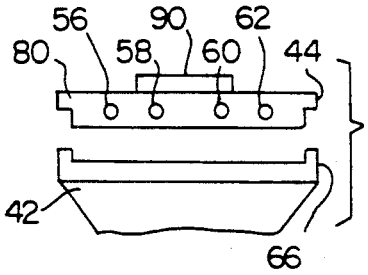
FIG. 6
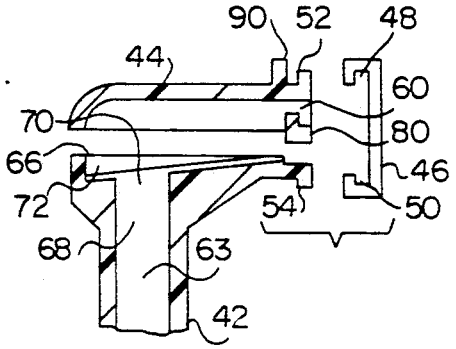
FIG. 7
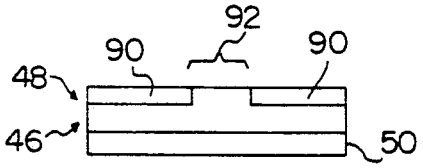
FIG. 7B
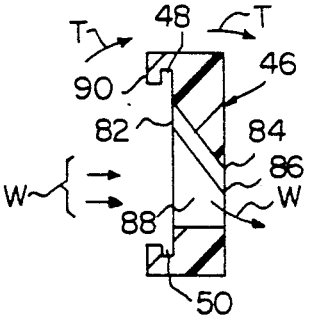
FIG. 7A
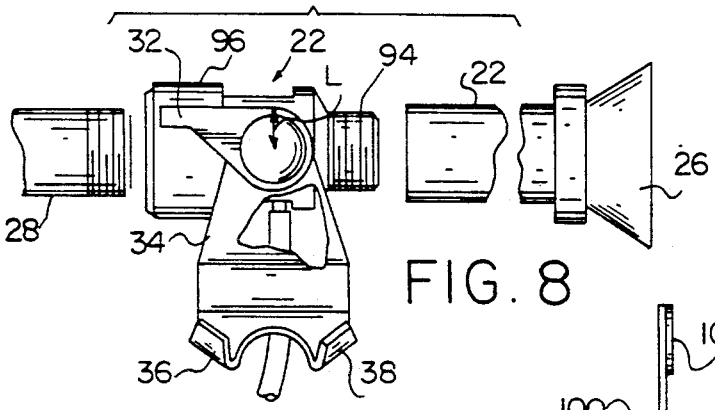
FIG. 8
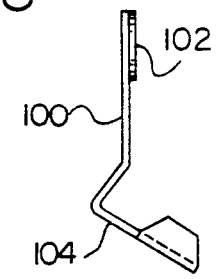
FIG. 10
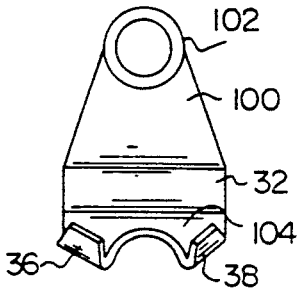
FIG. 9
FIG. 11
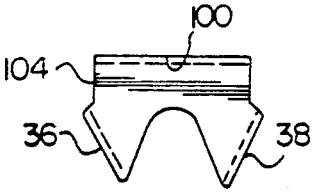

SHOWER SHAVER

This is a continuation-in-part of Ser. No. 07/501,029 filed Mar. 29, 1990, now U.S. Pat. No. 4,995,155 issued Feb. 26, 1991.

This invention relates to razors and the like for use in showers and more particularly, to shower shavers.

Many people, primarily women, like to use razors while in a shower, and preferably while water is running over an area which is to be shaved. This use leads to some rather complex problems which may be solved by connecting a razor through tubing to a plumbing pipe which delivers a steady stream of water to, past, and through the cutting blade. A few examples pertinent to such devices are found in U.S. Pat. Nos. 1,938,481; 2,336,806; 4,077,119; 4,177,556; 4,205,441; 4,228,586; 4,370,807; 4,633,585; and British Patent No. 541,723; 597,918.

A primary reason for using a razor having a blade which is wetted by a flowing stream of water grows out of various things such as the frequency of shaving, the angle of the razor for any given usage, and the comfort of the shaver. In general, an infrequent shaver tends to have tender skin. Therefore, the flowing water tends to make the act of shaving less irritating to the skin.

It s important to have the pattern of water flowing through the razor distributed in a manner which gives the best shaving results. The ability to use any of many commercially available razor blades, and the like, is also important. Another consideration is the cost of manufacture since a razor has tended to become almost a disposable item. Therefore, the cost of manufacture, ease of assembly, and the like are important considerations if the product is to be commercially successful.

Yet another consideration relates to peripheral matters such as the ease of installing the shower shaver water tubing in existing plumbing. The convenience of storing the razor in a handy-but-out-of-the-way place when not in use is quite important. The installation should provide an easy operation of a water valve for supplying water to the razor or to a shower head. Still another consideration is to provide a continuously variable valve which may direct all, some, or little water to the razor and the rest out of the shower head in order to have a desired amount of water for both the shaver and the shower head.

Accordingly, an object of the invention is to provide new and improved means for and methods of shower shaving. Another object is to provide shower shavers with superior water distribution patterns.

Still another object is to provide lightweight, low cost shower shavers.

In keeping with an aspect of the invention, the shower shaver is made from two plastic piece parts which are bonded together. A first part is a handle in the nature of a pipe terminating in a fan-shaped or flared, tray like top surface. The other piece part is a cover or top which fits over and cooperates with the tray top to form a cavity which delivers a flared sheet of water toward an orifice which exits under the edge of the blade. The parts forming a handle has a notch beneath the blade in order to direct a stream of water against the skin in front of the advancing blade as the razor is used. Some commercially available blades have a notch in them, for other purposes. This notch allows some of the sheet of water to escape behind the blade. The shower razor has an upstanding fence adjacent the notch for blocking the backward flight of the water escaping through the notch. The tubing or hose attached to the shower shaver razor leads to a nipple which may be interposed between a shower head and a plumbing pipe. A valve on the nipple provides a continuously variable control over the flow of water to the shaver and/or the shower head. A bracket or hanger is attached to the nipple to receive and support the razor when it is not in use.

A preferred embodiment of the invention is shown in the attached drawings, wherein:

FIG. 5 is a cross-section taken along line 5—5 of FIG. 4;

FIG. 6 is an exploded front elevation view of the handle and cover parts taken along line 6—6 of FIG. 4;

FIG. 7 is an exploded side elevation, in cross-section, of the handle and cover parts, and a razor blade taken along line 7-7 of FIG. 4;

FIG. 7A is a top plan view of a razor blade;

FIG. 7B is a cross-section view of a razor blade;

FIG. 8 is a side elevation of a nipple, valve, and hanger assembly used to install the shower shaver in a plumbing line;

FIG. 9 is a front elevation view of the hanger;

FIG. 10 is a side elevation view of the hanger;

FIG. 11 is a plan view of the hanger;

Figure 1:
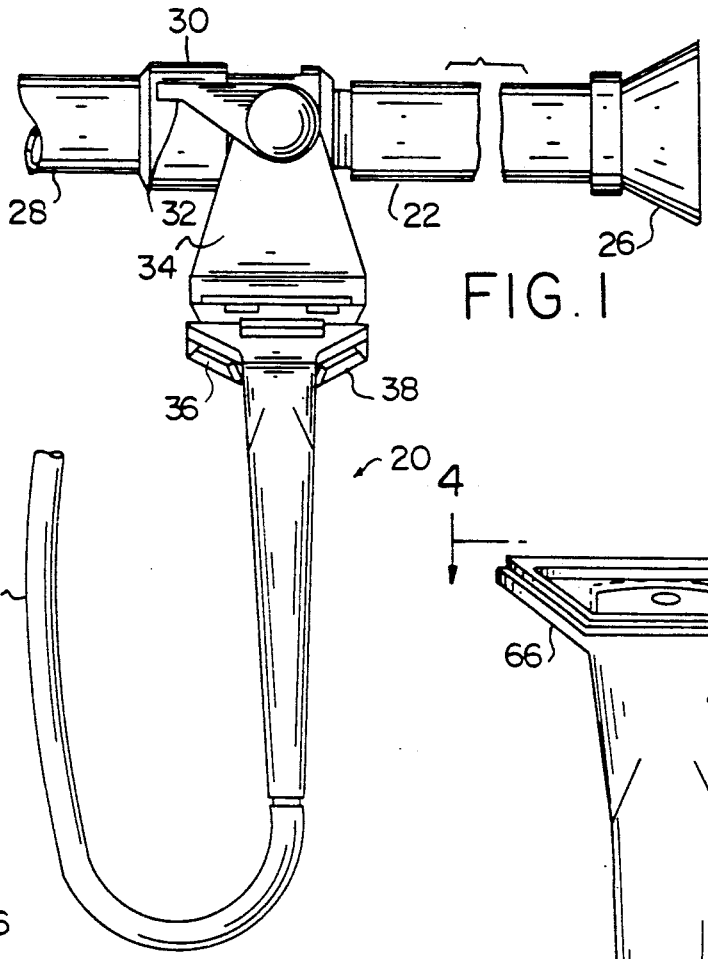
FIG. 1 is a back elevation of the inventive razor hanging on a bracket attached to a nipple coupled between a shower head and a plumbing pipe.
Figure 2:
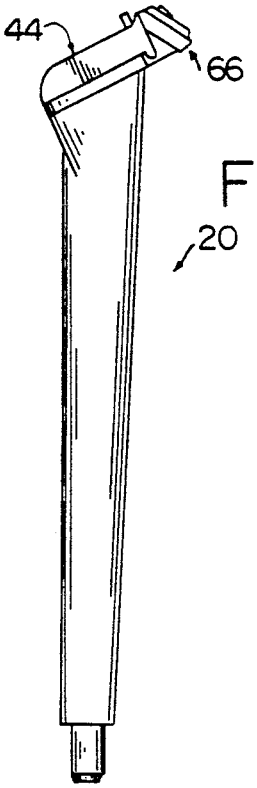
FIG. 2 is a side elevation of the inventive razor.

In FIG. 1, the inventive razor 20 is coupled to a nipple, valve, and hanger assembly 22 by a thin walled tubing 24. The nipple is installed by removing the shower head 26 from a plumbing pipe 28 which is normally a permanent part of the household plumbing. Thereafter, an end 30 on the nipple is turned onto the plumbing pipe 28 and the shower head 26 is placed on the opposite end of the nipple 22. The nipple includes a valve controlled by lever 32 which may divert some, all or none of the water to either the shower shaver 20 or the shower head 26.

Preferably, the tubing is long and thin walled to provide a flexible and pliable construction which enables the shaver to be positioned in any desired manner during use. This may be accomplished by a polyvinyl chloride (PVC) tubing made of FDA approved food grade material. The tubing should be in the order of seven to nine feet long, with eight feet preferred. The tubing wall thickness is in the range of 0.025 to 0.035 inches, with a 0.030 inches preferred. The inside diameter is in the range of 3/32 to 7/32 inches with 5/32 inches preferred. The durometer is in the range of 75-85, with 80 preferred.

This very thin wall thickness and long length provides a maximum flexibility and results in a low mass which makes it easy to wield the shaver. The long reach of the tubing provides a maximum reach for the razor. Hence, there is such a flexibility and ease of use that no special swivel or other fitting is required. The clear plastic enables the user to see any blockage or build up which may occur in the tubing.

A hanger 34 fits over a shaft extending to the valve and is held in place by the valve operating lever 32. The hanger is free to rotate on the shaft so that it hangs under the effect of gravity acting on its weight regardless of the angles of the plumbing pipe. The bottom of the hanger has two upturned ears 36, 38 for retaining the razor when it is hung up.

The internal construction of the razor 20 is best seen in FIGS. 2–7. Essentially, the razor itself is made of two plastic piece parts 42, 44, plus a commercially available razor blade 46. The blade 46 (FIG. 7)has two tracks 48, 50 which slide over two guide rails 52, 54 above and below water issuing passages 56–62. The razor blade may be any commercially available device, such as those shown in U.S. Pat. Nos.: 3,786,563 and 3,832,774.

Figure 4:
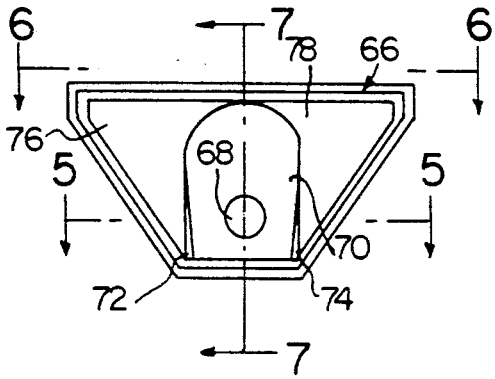
FIG. 4 is a top plan view of the handle part of the razor taken along line 4—4 of FIG. 3.
Figure 3:
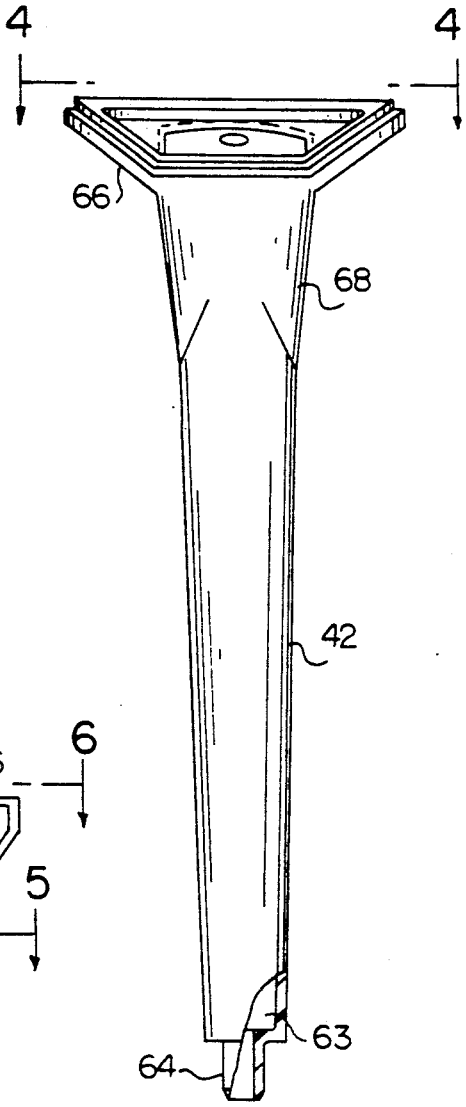
FIG. 3 is a back elevation of the handle part of the inventive razor.

The handle part 42 is, in part, a hollow tube 63 extending from an end fitting 64 to a tray-like shape 66 at the top of the handle. The tubing 24 is attached to the end fitting 64, by any suitable means. The hollow tube 63 ends in an exit opening 68 in a depression 70 at the center of the upper surface of the tray member 66. The depression 70 has sloping side walls 72, 74 leading to a truncated triangular plane or land 76, 78 (FIG. 4). Thus, when the valve 32 on nipple 22 is opened, water flows through tube 63, into handle 42, and out an opening at the upper tray shape 66. The shape, dimensions, and construction of the tray shape is seen in FIGS. 4–7.

The second plastic piece part forming the razor body is a top or cover 44. The cover fits over the tray-like member 66 where it is bonded in place. The front wall 80 of the cover 44 includes four orifices or holes 56, 58, 60, 62 through which the water may stream from the razor toward the blade. The cover provides essentially a smooth interior surface over the tray 66 in order to complete a fan shaped chamber for directing a sheet of water in a forward direction toward the confronting surface razor blade 46.

In greater detail, the lower surface of the cover part 44 cooperates with the upper surface of the tray to form a somewhat fan-shaped cavity directed at the blade. The hollow tube 63 has an exit 68 which communicates into the small end of the fan shape. The blade orifices 56–62 are at the wide end of the fan shape. This configuration gives the water emitted through opening 68 a smooth transition into a flowing triangular sheet of water directed forwardly, out of the front of the razor, striking the broad flat surfaces of the blade from which it is deflected under the cutting edges of the blade.

FIG. 7A shows a stylized razor blade 46 in cross-section which is representative of many commercially available blades. The blade itself is a sheet of metal 82 folded to a somewhat U-shape with two sharpened edges 84, 86 at the open edges of the U-shape. An open space 88 is below the blades so that the water represented by arrows W flow under the blades and wet the skin just ahead of the cutting edges. Water cannot enter either the back of the U-shaped blade or fold over the top of the blade which is embedded in plastic.

FIG. 7B shows a stylized back of some of the commercially available blades 46. The discontinuous track 48 is formed behind track guides 90, 90 with a notch 92. Therefore, water may issue from this notch and squirt back toward the face of the user. To forestall such a possibility that the user may be squirted in the face, behind the notch 92 and on top of the cover 44, there is an upstanding fence or deflector 90 which redirects the water from notch 92 away from the user, and preferably in a forward direction toward the skin being shaved. This redirected water flow is indicated by the arrows T, T in FIG. 7A.

The details of the nipple 22 are shown in FIG. 8. More particularly, a plastic pipe has threads 94 on one end and a coupler 96 on the opposite end. The sower head 26 fits on one end and the plumbing pipe 28 receives the other end of the nipple 22. The valve inside the nipple may be any suitable device (such as a stopcock) controlled by rotating a shaft. The shaft position is selected by a handle 32 which is off-set by a distance "L" from the center of rotation, thus providing a lever arm which makes it easy to rotate the valve, even when there is a high water pressure. The valve is continuously variable from one position which directs all water out the shower head 26 and another position which directs all water out the tubing 22 to the shower shaver. In between, water flows out both the shower head 26 and the tubing 22 in varying degrees that are selected by the valve position.

Behind the handle 32 and freely rotating on the shaft of the valve is a hanger 34, which is shown in detail in FIGS. 9–11. In greater detail, the hanger 32 is preferably a molded plastic part which is an arm 100 having a hole 102 in one end and a flat part 104 terminating in oppositely disposed ears 36, 38 for receiving and capturing the razor. The shaft of the valve passes freely through the hole 102; therefore, regardless of the preexisting angle of plumbing pipe 28, the hanger 100 always hangs downwardly under gravity The head of the razor sets on part 104 and behind ears 36, 38.

Figure 12:
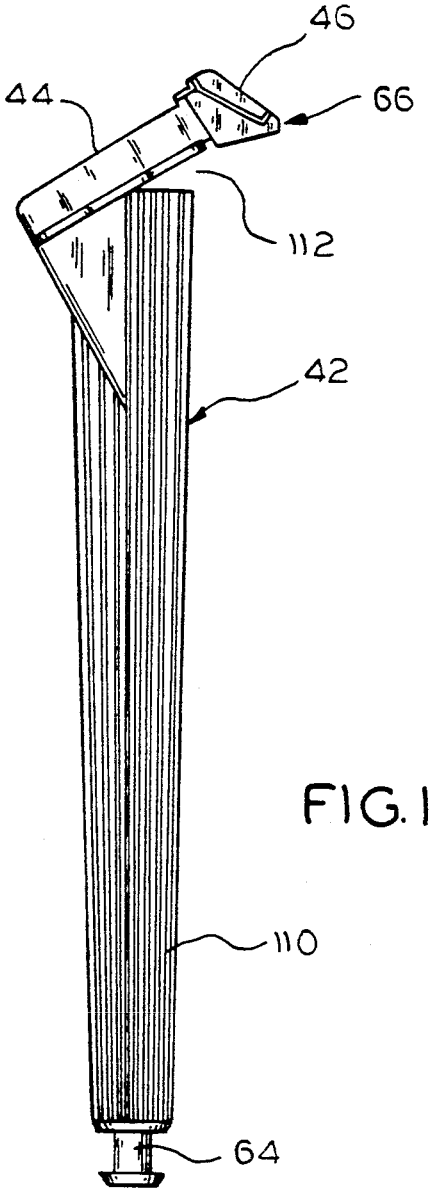
FIG. 12 is a side elevation of a second embodiment of the invention showing a notch for directing a stream of water against the skin, in front of the advancing razor.
Figure 13:
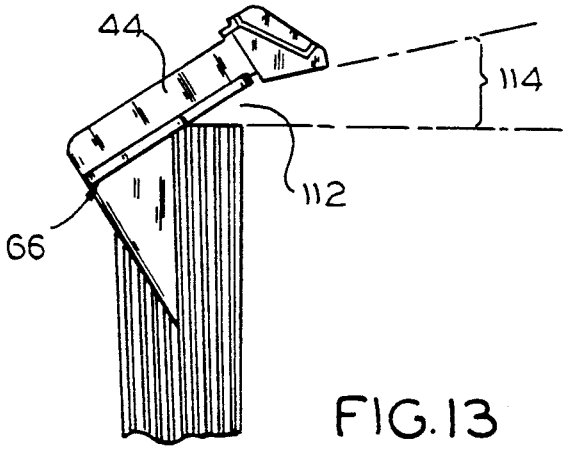
FIG. 13 is a side elevation showing the stream of water issuing from the notch of the embodiment of FIG. 12.
Figure 14:
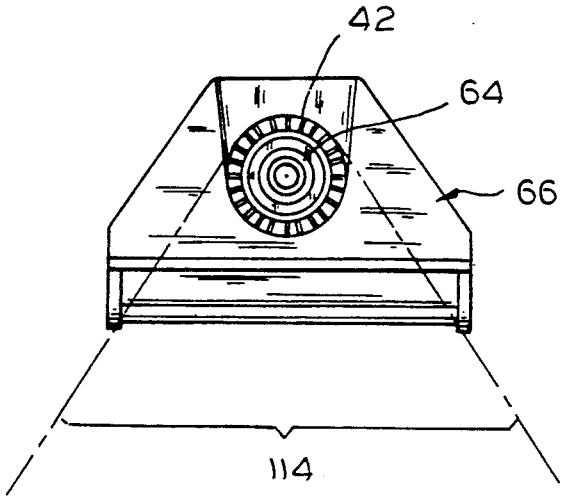
FIG. 14 is a bottom plan view showing the stream of water issuing from the notch of the embodiment of FIG. 12.

A second embodiment of the invention is shown in FIGS. 12–14. The parts in these figures are substantially the same as the corresponding parts shown in the preceding figures except for longitudinal grooves 110 along the length of the handle and a notch 112 in the top of the handle. The grooves 110 make it easier to hold the razor when one is in a shower with wet and perhaps soapy hands.

The notch 112 has a "V" or wedge shape and is merely cut into the handle at a location immediately below the blade 46. Since the edge of the blade is set to cut the user's hair when the handle is pulled downwardly (as seen in FIG. 12), the stream of water 114 (FIGS. 13, 14) issuing from the notch 112 sprays the skin in front of the advancing blade. The size of the notch 112 is selected as a function of the size of the holes 56–62 (FIG. 6). The water issuing through holes 56–62 should be adequate to wash the debris from the blade, but not enough to push the skin away from the blade, cause a spray out the ends of the razor blade, etc. Once the desired amount of water is issuing through holes 56–62 is selected, the notch 112 is made large enough to drain away all remaining water that can pass through the tubing 24 at normal water pressure.

The tube forming handle 42 is directed toward the underside of the tray-like member 66. Therefore, the stream of water strikes the under, outside surface of member 66 which guides and directs it along the truncated triangular shape of the tray formed at the top of the handle. As a result, a fan shaped sheet of water approximately the width of the blade strikes the skin.

Those who are skilled in the art will readily perceive how to modify the invention. Therefore, the appended claims are to be construed to cover all equivalent structures which fall within the true scope and spirit of the invention.

The invention claimed is:

1. A shower shaver comprising a handle having an upper generally flat somewhat tray-like surface and further having a channel extending through said handle, means at a front of said tray-like surface for supporting a razor blade, said channel having two opposite ends one of which terminates at and communicates into said upper surface, a notch extending from said channel to the outside of said handle at a location beneath an under outside surface of said tray-like surface, said notch directing a fan shaped spray toward said blade support, a flexible tubing connected directly to said handle at an opposite end of said channel, a generally flat cover part with an internal surface attached to and above the upper tray-like surface, said internal surface of said cover part and said upper surface of said handle part cooperating to form a generally flat somewhat fan shaped cavity, at least one orifice in said cavity for emitting water directed toward said blade, said fan shaped cavity directing a sheet of water toward said orifice, thereby bathing said blade with a fast moving stream of water.

2. The shower shaver of claim 1 having a nipple attached to an opposite end of said tubing, said nipple having threads on opposite ends thereof so that said nipple may be inserted between a shower head and a plumbing pipe, a valve in said nipple for directing water flowing through said nipple toward either said shower head or said tubing.

3. The shower shaver of claim 1 and longitudinal grooves extending along a length of said handle.

4. The shower shaver of either of the claims 1 or 2 wherein at least some of the blades which may be attached to said shaver have a notch which may cause water to be directed backwardly, the external surface of said cover part having an upstanding fence adjacent said support means for attaching said razor blade, said fence being positioned opposite said notch to redirect said backwardly directed water toward said blade.

5. A shower shaver comprising a handle with a channel terminating in a generally flat somwhat fan shaped cavity at one end thereof, said channel communication with a small end of said fan-shaped cavity, a plurality of orifices at a wide end of said fan-shaped cavity, a removable and replaceable razor blade support at said orifices, said blade support being positioned to direct water issuing from said orifices against a flat surface of said blade under a cutting edge of said blade to bathe the user's skin with water immediately in front of said cutting edge, means formed on said handle and directed toward said blade support for bathing the users skin with a stream of water in front of said cutting edge.

6. The shower shaver of claim 5 wherein said orifices deliver enough water to wash debris away from said blade, and said means formed on said handle delivers enough water in said stream of water to prevent the water delivered from said orifice from pushing the user's skin away from said cutting edge, or from issuing from the ends of the blade.

7. The shower shaver of either claim 5 or claim 6 wherein the under outside of the part of said handle which forms said cavity directs said stream of water in a spray which substantially conforms to the width of said replaceable razor blade.

8. The shower shaver of one of the claims 5 or 6 wherein said means formed on said handle to deliver said stream of water is a wedge shaped slot cut into said handle and extending into said channel.

9. The shower shaver of one of claim 7 wherein said means formed on said handle to deliver said stream of water is a wedge shaped slot cut into said handle and extending into said channel.

* * * * *